US009075346B2

(12) United States Patent
Tsukada

(10) Patent No.: US 9,075,346 B2
(45) Date of Patent: Jul. 7, 2015

(54) IMAGE FORMING APPARATUS HAVING TONER SUPPLY CONTROL

(71) Applicant: CANON KABUSHIKI KAISHA, Tokyo (JP)

(72) Inventor: Yoshiro Tsukada, Matsudo (JP)

(73) Assignee: CANON KABUSHIKI KAISHA, Tokyo ( * ) Notice: Subject to any disclaimer, the term of this patent is extended or adjusted under 35 U.S.C. 154(b) by 151 days.

(21) Appl. No.: 13/680,229

(22) Filed: Nov. 19, 2012

(65) Prior Publication Data

US 2013/0142527 A1 Jun. 6, 2013

(30) Foreign Application Priority Data

Dec. 1, 2011 (JP) ..... 2011-264058

(51) Int. Cl.
*G03G 15/08* (2006.01)
*G03G 15/09* (2006.01)

(52) U.S. Cl.
CPC ..... *G03G 15/09* (2013.01); *G03G 15/0853* (2013.01); *G03G 15/0877* (2013.01)

(58) Field of Classification Search
CPC G03G 15/09; G03G 15/0853; G03G 15/0877
USPC ..... 399/27, 29, 30
See application file for complete search history.

(56) References Cited

U.S. PATENT DOCUMENTS

| | | | | |
|---|---|---|---|---|
| 5,778,279 | A * | 7/1998 | Kawai et al. | 399/42 |
| 8,385,754 | B2 | 2/2013 | Hirobe et al. | |
| 2011/0052221 | A1* | 3/2011 | Hirobe et al. | 399/27 |

FOREIGN PATENT DOCUMENTS

| | | | |
|---|---|---|---|
| JP | 07-013430 | A | 1/1995 |
| JP | 10-307434 | A | 11/1998 |
| JP | 2004-85707 | A | 3/2004 |
| JP | 3542148 | A | 7/2004 |
| JP | 2010-48859 | A | 3/2010 |
| JP | 2011-128248 | A | 6/2011 |

* cited by examiner

*Primary Examiner* — Rodney Bonnette
(74) *Attorney, Agent, or Firm* — Fitzpatrick, Cella, Harper & Scinto

(57) ABSTRACT

A developing device in an image forming apparatus includes a developer bearing member that bears a developer including toner and a carrier, and first and second toner chambers. In addition, a supplying unit supplies toner to the first or second chamber, a magnetic detection element generates an output according to a magnetic density of the developer of the first or second chamber, and a controller controls a toner supply amount. A timer detects information of a time regarding operating of first and second conveying units. Based on the information detected by the timer irrespective of a length of a progress period from an end of a previous image forming process to a start of a subsequent image forming process, in a case that each elapsed period of time before the first and second conveying units start operating is under a predetermined time, the controller sets the supply amount of the supplying unit according to output of the magnetic detection element to be smaller than a case that each elapsed period of time is over the predetermined time.

10 Claims, 11 Drawing Sheets

IMAGE FORMING APPARATUS HAVING TONER SUPPLY CONTROL

BACKGROUND OF THE INVENTION

1. Field of the Invention

The present invention relates to an image forming apparatus that includes a developing device including first and second chambers, which are vertically disposed and accommodate a developer, and controls a toner supply amount of the developing device based on an output obtained by causing a magnetic detection element to detect the developer circulating inside the developing device. More particularly, the present invention relates to toner supply control of correcting an error of a relation between the output of a magnetic detection element and an actual toner density at a predetermined time after activation of the developing device.

2. Description of the Related Art

Image forming apparatuses have widely been used in which an electrostatic image formed in an image bearing member is developed into a toner image by a developing device, the toner image of the image bearing member is transferred to a recording material directly or through an intermediate transfer member, the recording material to which the toner image is transferred is heated and pressurized, and an image is fixed to the recording material. As the developing device, a developing device of a two-component developing system is widely used which develops an electrostatic image of the image bearing member into a toner image using a two-component developer in which toner and a carrier are mixed.

The developing device of the two-component developing system will be described with reference to FIG. 2. In the developing device 1 of the two-component developing system, only the toner is extracted from the developer with formation of an image. The supply developer having toner as a main component is supplied from a supplying unit 20 to the developing device 1. In the developing device 1, a magnetic detection element 14 that measures a toner density is provided to balance consumption and supply of the toner in the developing device 1 and maintain the toner density of the developer inside the developing device 1 in a predetermined range.

The toner density is a weight ratio of the toner occupying the developer in a unit weight in the developing device 1. A suitable toner density is considered to be normally in the range of about 5% to 11%. When the toner density falls by 5%, sufficient toner may not be attached to an electrostatic image and an image density tends to decrease. When the toner density exceeds 11%, the toner that is not attached to the surface of a carrier increases. Therefore, the toner flying from a rotating developer bearing member 8 tends to increase.

Japanese Patent Laid-Open No. 10-307434 discloses an image forming apparatus that controls toner supply from the supplying unit 20 to the developing device 1 such that an estimated value of the toner density estimated based on output of the magnetic detection element 14 is maintained constantly. Here, a time at which the output of the magnetic detection element 14 is stabilized is retarded with deterioration in fluidity of the developer. Therefore, as the cumulative use time of the developer is longer, an acquisition time of the output of the magnetic detection element 14 is more delayed.

In the developing device disclosed in Japanese Patent Application Laid-Open No. 10-307434, an image starts to be formed after the circulation of the developer inside the developing device is normalized and the output of the magnetic detection element 14 is stabilized. Further, after the first image is completely formed, the supply amount of developer is determined based on the output of the magnetic detection element 14. At this time, in a vertical agitating type developing device in which a developing chamber and an agitating chamber are vertically disposed as illustrated in FIG. 2, it takes some time until the circulation balance enters a normal state after the activation of the developing device in order to realize a circulation in which the developer is raised and circulated in the developing device. For this reason, as illustrated in FIG. 5, the output of the magnetic detection element 14 may change after the activation of the developing device. In this case, even when the developer is a new product, it takes three seconds or more to start forming the first image after the activation of the developing device. When the developer becomes old and the fluidity deteriorates, it takes five seconds or more to start forming the first image after the activation of the developing device.

Therefore, the first sheet of image may not start to be formed unless an idle operation of the developing device 1 continues for three seconds or more until the stabilization of the output of the magnetic detection element 14 after the activation of the developing device. The supply amount of developer may not be determined based on the output of the magnetic detection element 14 until the first sheet of image is completely formed.

In consideration of productivity and responsiveness of the image forming apparatus and agitating deterioration of the developer in the developing device, the idle operation time after the activation of the developing device is preferably shortened as much as possible. For example, for the purpose of FAX reception of a multifunctional apparatus, an image forming process of forming only one sheet is performed in many cases. It is assumed that an image forming process of forming one sheet is intermittently instructed ten times and the developing device is stopped/activated at every time. Then, when an image can start to be formed without waiting the stabilization of the output of the magnetic detection element, image formation productivity can be considerably improved. When the supply amount of developer is determined without waiting the stabilization of the output of the magnetic detection element 14 and the determined amount of developer is supplied at the time of forming the first sheet of image, it is not necessary to perform the idle operation to supply the developer after the formation of the first sheet of image.

SUMMARY OF THE INVENTION

It is desirable to provide an image forming apparatus capable of supplying a developer with high accuracy even when a vertical agitating type developing device in which a developing chamber and an agitating chamber are vertically disposed is activated, and then starts developing before a normal state of circulation balance of the developer.

According to an aspect of the invention, an image forming apparatus includes: a developer bearing member that bears a developer including toner and a carrier; a first chamber that is disposed to face a surface of the developer bearing member and supplies the developer to the developer bearing member; a second chamber that is disposed to face the surface of the developer bearing member at a position vertically different from a position of the first chamber and that collects the developer from the developer bearing member and communicates with both ends of the first chamber to form a circulation path along which the developer is circulated; a supplying unit that supplies toner to the first or second chamber; a magnetic detection element that generates an output according to a magnetic density of the developer of the first or second chamber; a controller that controls a supply amount supplied by the supplying unit based on the output of the magnetic detection element; and a timer that detects information regarding an elapsed time after the developer starts to be conveyed by first and second conveying units according to an image formation start signal. Based on the information detected by the timer irrespective of a length of a progress period from end of a previous image forming process to start of a subsequent image forming process, the controller controls the supply amount of the supplying unit with respect to the same output value of the magnetic detection element such that the supply amount is smaller when the elapsed time is less than a predetermined time than when the elapsed time is equal to or greater than the predetermined time.

Further features of the present invention will become apparent from the following description of exemplary embodiments with reference to the attached drawings.

DESCRIPTION OF THE EMBODIMENTS

Hereinafter, embodiments of the invention will be described in detail with reference to the drawings. Some or all of the configurations of the embodiments of the invention can be substituted with other embodiments, as long as the toner density of a developer is determined after a developing device is activated and then the output of a magnetic detection element is stabilized.

The magnetic detection element refers generally to a sensor that measures a change in a magnetic physical property according to the number (density) of carriers per developer of a unit volume, and includes a sensor that measures the amount of magnetization of a developer, the density of magnetic flux, the coercive force, the induced electric field, the magnetic resistance, or the like of a developer across magnetization or a magnetic field from the outside.

Control of the toner supply amount based on the output of a magnetic detection element may be performed based on only the output of the magnetic detection element. However, control of the toner supply amount based on the detection of an amount of toner attached to a patch image may be combined with control of the toner supply amount performed by calculating the amount of toner consumed per image based on image data, an exposure signal, or the like.

An image forming apparatus can perform a process irrespective of full-color/monochrome, a one-drum type/tandem type, a direct-transfer type/recording material convey type/intermediately transfer type, a kind of image bearing member, a charging type, an exposure type, a transfer type, or a fixing type, as long as the image forming apparatus uses a two-component developer. In the embodiments, only main units relevant to formation/transfer of a toner image are described, but the invention can be realized for various uses of printers, various printing machines, copying machines, FAX, multi-function apparatuses, or the like in addition to the necessary apparatuses, machines, or casing structures.

Figure 1:
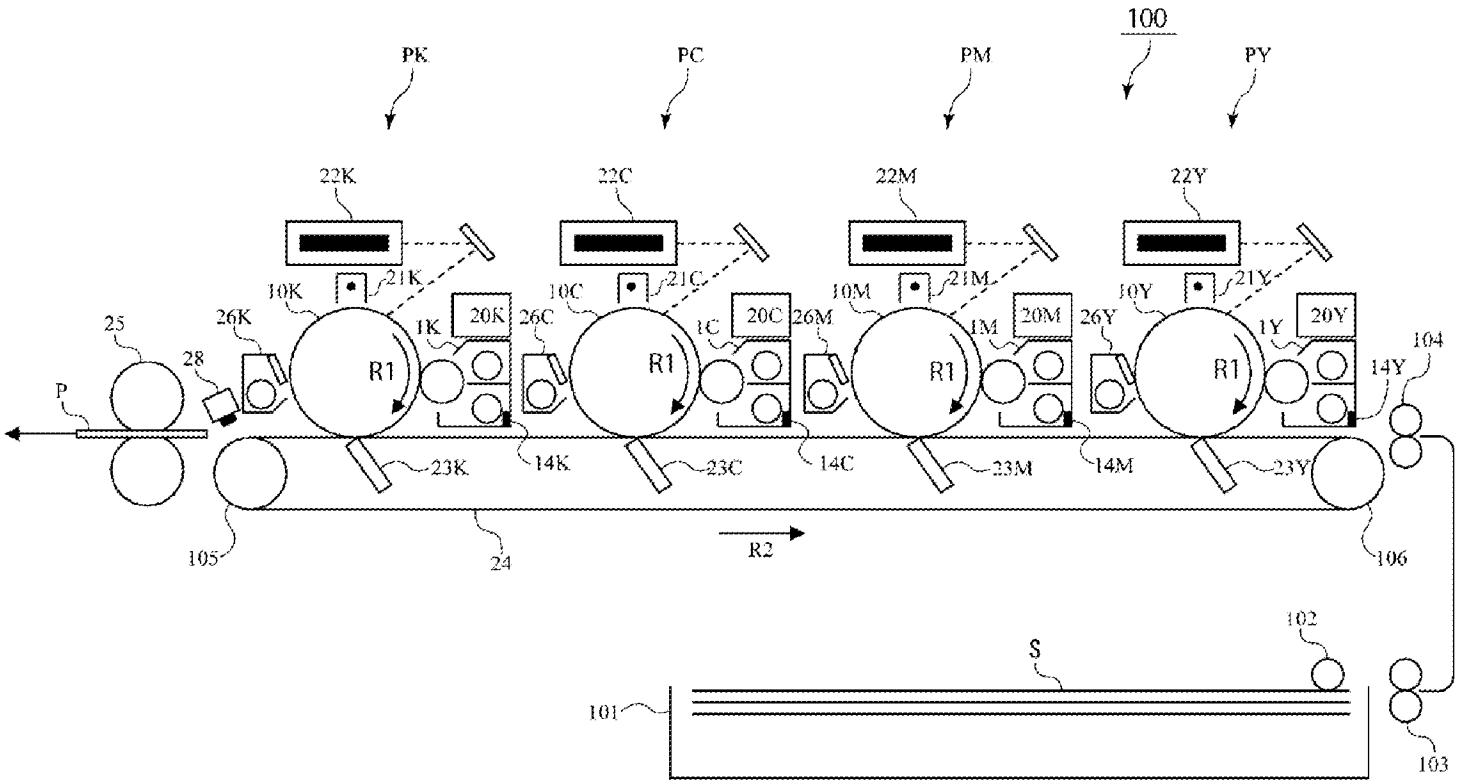
FIG. 1 is a diagram illustrating the configuration of an image forming apparatus.

<Image Forming Apparatus> FIG. 1 is a diagram illustrating the configuration of the image forming apparatus. As illustrated in FIG. 1, the image forming apparatus 100 is a full-color printer of a tandem type recording material convey system in which image forming units PY, PM, PC, and PK are arranged along a recording material conveying belt 24.

Separating rollers 103 separate recording materials S picked up from a recording material cassette 101 by a pick-up roller 102 one by one and send the recording material S to registration rollers 104. The registration rollers 104 send the recording material S to the recording material conveying belt 24 according to a timing of a toner image of a photoconductive drum 10Y.

In the image forming unit PY, a yellow toner image is formed on the photoconductive drum 10Y and is transferred to the recording material S born on the recording material conveying belt 24. In the image forming unit PM, a magenta toner image is formed on a photoconductive drum 10M and is transferred to the recording material S born on the recording material conveying belt 24. In the image forming units PC and PK, a cyan toner image and a black toner image are formed on the photoconductive drums 10C and 10K, respectively, and are transferred to the recording material S born on the recording material conveying belt 24.

The recording material S to which the four-color toner images are transferred is curvature-separated from the recording material conveying belt 24, and is fed to a fixing device 25. The recording material S is discharged to the outside of the apparatus body after the toner images are heated and pressurized by the fixing device 25 and are thus fixed to the surface of the recording material S.

The image forming units PY, PM, PC, and PK have substantially the same configuration except that the colors of the toner used in developing devices 1Y, 1M, 1C, and 1K are different as yellow, magenta, cyan, and black, respectively. Hereinafter, the configuration and operation of the image forming unit P will generally be described in which a reference numeral having no Y, M, C, and K at the end of the reference numeral indicating that the image forming units PY, PM, PC, and PK are distinguished from each other is given to a constituent member.

In the image forming unit P, a corona charger 21, an exposure device 22, the developing device 1, a transfer blade 23, and a drum cleaning device 26 are arranged around the photoconductive drum 10. The photoconductive drum 10 includes a photoconductive layer on the outer circumferential surface of a cylinder made of aluminum and is rotated in the direction of an arrow R1 at a predetermined process speed.

The corona charger 21 irradiates charged particles caused by corona discharging to the photoconductive drum 10 such that the photoconductive drum 10 is charged uniformly with a negative polar dark-part potential VD. The exposure device 22 writes an electrostatic image of an image to the surface of the charged photoconductive drum 10 by scanning a laser beam, which is obtained by performing ON-OFF modulation on scanning-line image data in which respective separated color images are developed, using a rotation mirror. The developing device 1 supplies the toner to the photoconductive drum 10 and develops the electrostatic image to the toner image.

The recording material conveying belt 24 is suspended and supported by a tension roller 106 and a driving roller 105 and is rotated in the direction of an arrow R2 when the driving roller 105 is driven. The transfer blade 23 pressurizes the recording material conveying belt 24 so that a transfer portion is formed between the photoconductive drum 10 and the recording material conveying belt 24.

By applying a direct-current voltage with an opposite-polarity to the charged polarity of the toner to the transfer blade 23, the toner image born on the photoconductive drum 10 is transferred onto the recording material conveying belt 24. The drum cleaning device 26 causes a cleaning blade to rub the photoconductive drum 10 and collects the remaining toner attached to the surface of the photoconductive drum 10 having passed through the transfer portion.

Figure 2:
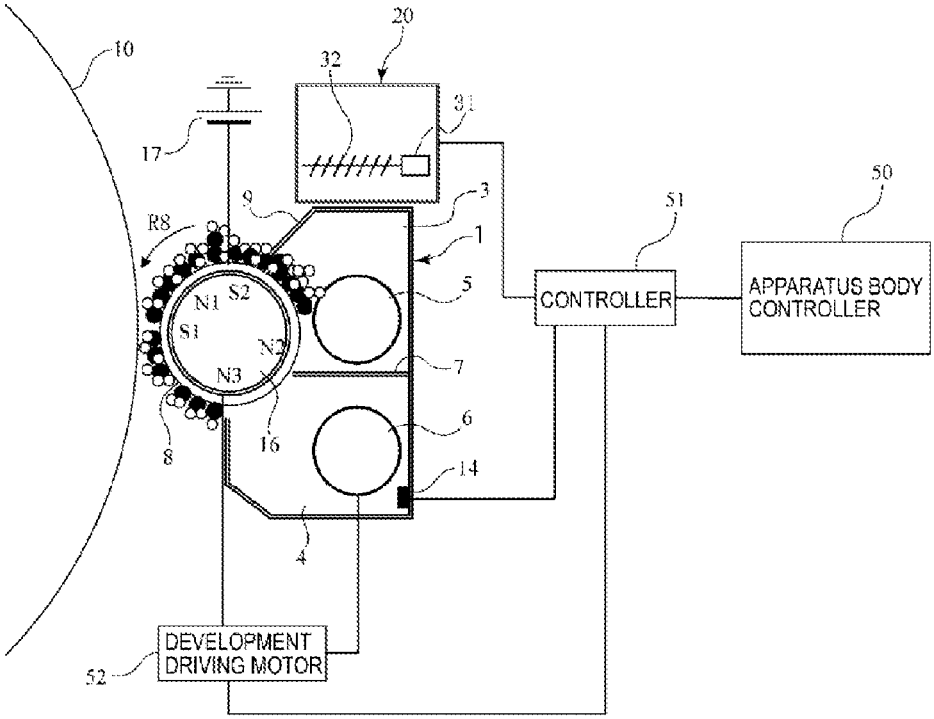
FIG. 2 is a diagram illustrating the configuration of an axis vertical cross-section of a developing device.
Figure 3:
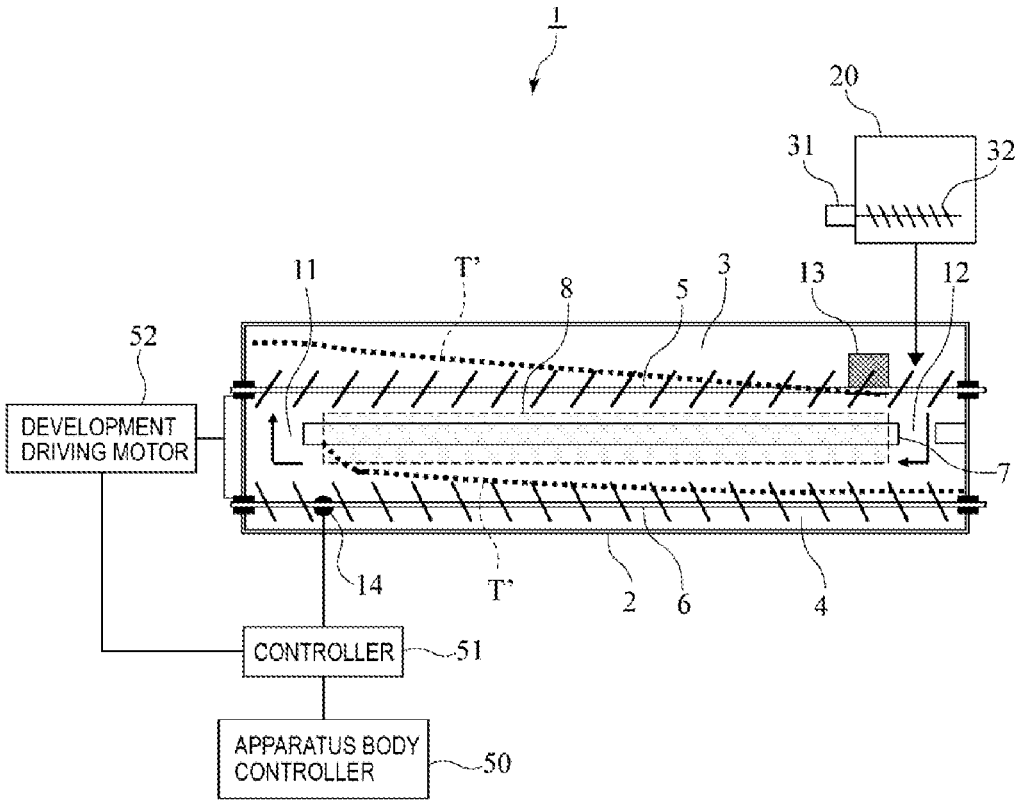
FIG. 3 is a diagram illustrating the height of the surface level of the developer of the developing device in operation.
Figure 4:
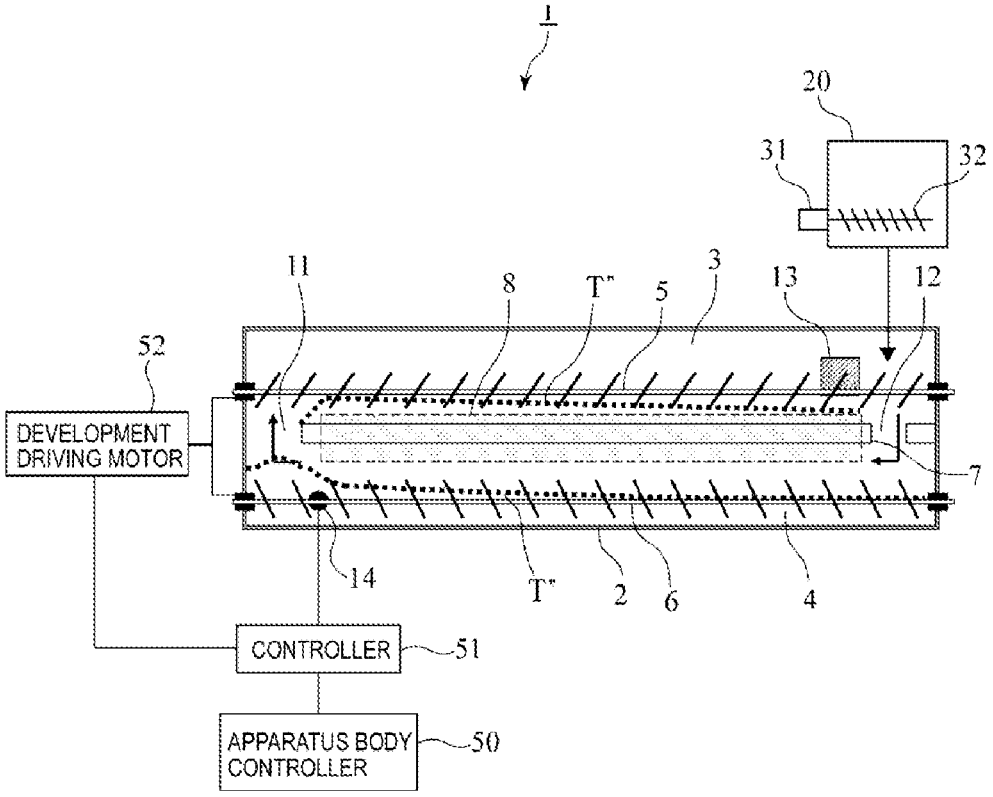
FIG. 4 is a diagram illustrating the height of the surface level of the developer of the developing device in suspension.

<Developing Device> FIG. 2 is a diagram illustrating the configuration of the developing device in cross-sectional view taken along the plane perpendicular to a shaft. FIG. 3 is a diagram illustrating the height of the surface level of the developer of the developing device in operation. FIG. 4 is a diagram illustrating the height of the surface level of the developer of the developing device in suspension.

In an image forming apparatus of an electrophotographic system, in recent years, a time (so-called first copy time) from activation of the image forming apparatus or a return from sleep to image formation start, which is one of the capabilities of print-on demands (POD), has needed to be shortened. The image forming apparatus needs to be miniaturized/reduced in cost, while a high-speed printing capability and high reproducibility of image density/colors of the image forming apparatus are achieved.

In a conventional horizontal agitating and developing device, a developing chamber and an agitating chamber are vertically adjacent to each other. Therefore, a developer is born by a developing sleeve in the developing chamber and developing is performed, the developer with a lowered toner density is returned to the developing chamber, and then the developer is born in the developing sleeve again with the toner density lowered and the developing is performed. Therefore, the toner density of the developer is lowered as the developer is present on the downstream side of the developing chamber. Thus, a density difference/color difference easily occurs between images developed on the upstream side and on the downstream side of the developing chamber.

As illustrated in FIG. 2, the developing device 1 is a vertical agitating type developing device in which a developing chamber 3 and an agitating chamber 4 are vertically adjacent to each other. The vertical agitating type developing device has the advantages over a conventional horizontal agitating and developing device in that a high-speed printing capability, high reproducibility of image density/colors, and miniaturization/cost reduction are achieved.

A developing sleeve 8 which is an example of a developer bearing member bears a developer including toner and carriers. The developing chamber 3 and a developing screw 5 which are an example of a first conveying unit supply the developer to the developing sleeve 8 while conveying the developer along the developing sleeve 8. The agitating chamber 4 and an agitating screw 6 which are an example of a second conveying unit communicate with the developing chamber 3 and form a circulation path of the developer, and collect the developer from the developing sleeve 8, while conveying the developer along the developing sleeve 8.

In the developing device 1, the developer is born by the developing sleeve 8 in the developing chamber 3 and the developing is performed, and the developer with a lowered toner density is returned to the agitating chamber 4. Therefore, the toner density of the developer on the upstream side of the developing chamber 3 is the same as that of the developer on the downstream side of the developing chamber 3. Therefore, the density difference/color difference rarely occurs between the images developed on the upstream side and the downstream side of the developing chamber 3. In the developing device 1, the developer sufficiently mixed with the toner supplied during the conveyance of the agitating chamber 4 is raised from the agitating chamber 4 to the developing chamber 3 to be used for the developing. Thus, the developing device 1 has the advantages over a conventional horizontal agitating developing device in that an image failure caused due to irregularity of the toner density rarely occurs and in-plane uniformity of the image density is improved.

A developing container 2 of the developing device 1 is filled with a predetermined amount of two-component developer (hereinafter, simply referred to as a developer) in which a toner density including toner (non-magnetism) and carriers (magnetism) is 8%. The toner density is a weight ratio (%) of the toner occupying the developer in unit weight and is an important parameter that expresses a mixture ratio between the carriers and the toner.

As illustrated in FIG. 3, a space inside the developing container 2 is partitioned vertically into upper and lower portions, that is, the upper developing chamber 3 and the lower agitating chamber 4 by a partition wall 7 extending in a direction perpendicular to the sheet surface. Openings 11 and 12 are formed at both ends of the partition wall 7 and cause the developing chamber 3 and the agitating chamber 4 to communicate with each other, and thus a circulation path of the developer with which the developing container 2 is filled is formed.

In the developing chamber 3, the developing screw 5 is disposed to agitate/convey the developer. The developing screw 5 has a screw structure in which a blade member made of a non-magnetic resin material is formed in a spiral shape around a rotation shaft made of ferromagnetic soft steel. The developing screw 5 is disposed in the bottom portion of the developing chamber 3 to be parallel with the developing sleeve 8. During the operation of the developing device 1, the screw 5 conveys the developer of the developing chamber 3 sent to and received from the agitating chamber 4 through the opening 11 in one direction along the developing screw 5 and sends the toner to and from the agitating chamber 4 through the opening 12. In the developing chamber 3, the developing screw 5 supplies, the developing sleeve 8, some of the developer being conveyed, as illustrated in FIG. 2, while conveying the developer sent to and received from the agitating chamber 4 to the downstream side.

The layer thickness of the developer supplied to the developing sleeve 8 by the developing screw 5 is regulated by a layer-thickness regulating blade 9, the developer is conveyed to a developing portion facing the photoconductive drum 10, and the toner is transferred to the electrostatic image on the photoconductive drum 10. The developer with a toner density lowered due to consumption of the toner is returned to the agitating chamber 4 with the rotation of the developing sleeve 8, is separated from the developing sleeve 8, and joins to the developer to be conveyed in the agitating chamber 4 by the agitating screw 6.

In the agitating chamber 4, the agitating screw 6 is disposed to agitate/convey the developer. The agitating screw 6 has a screw structure in which a blade member made of a resin material is formed in a spiral shape wound reversely to the developing screw 5 around a rotation shaft made of soft steel. The agitating screw 6 is disposed in the bottom portion of the agitating chamber 4 to be parallel with the developing screw 5. During the operation of the developing device 1, the agitating screw 6 is rotated in the same direction as that of the developing screw 5, and thus conveys the developer in the opposite direction to that of the developing screw 5. The agitating screw 6 conveys the developer sent to and received from the developing chamber 3 through the opening 12 in the opposite direction to that of the developing screw 5, and thus sends and receives the developer to and from the developing chamber 3 through the opening 11.

The developing screw 5 and the agitating screw 6 circulate the developer inside the developing container 2 in the developing chamber 3 and the agitating chamber 4, and thus agitate and mix the toner and the carriers of the developer to charge the toner and the carriers negatively and positively, respectively.

As illustrated in FIG. 2, the developing sleeve 8 is disposed to be rotatable in the developing container 2 and is partially exposed in the direction of the photoconductive drum 10 through the opening of the developing container 2. The developing sleeve 8 can be made of a metal such as stainless steel or aluminum, which is a conductive non-magnetic material, a resin material in which conductive particles are dispersed and conductivity is granted, or other materials known from the past. Here, the developing sleeve 8 is made of an aluminum cylinder material and is subjected to a process of roughening a surface such as a blast process using glass beads in order to improve the conveyance property of the developer.

A magnet roller 16 is installed inside the developing sleeve 8 so as not to be rotated. The magnet roller 16 may be a permanent magnet that normally generates a magnetic field or may be a collective of electromagnets that arbitrarily generate a uniform magnetic field or a magnetic field of different polarities and distributions.

The magnet roller 16 disposes a plurality of magnetic poles inside the developing sleeve 8 so as not to be moved relatively with respect to the developing sleeve 8. The magnet roller 16 has a developing pole S1 in a developing portion of the developing sleeve 8 facing the photoconductive drum 10. Magnetic poles N2, S2, and N1 convey the developer toward the developing pole S1. A magnetic pole N3 conveys the developer from the developing pole S1 to the inside of the developing container 2. The magnetic poles N3 and N2 separate the developer from the developing sleeve 8.

The layer-thickness regulating blade 9 is disposed at a position which is on the upstream side of the developing sleeve 8 from the photoconductive drum 10 in the rotation direction and faces the magnetic pole S2 with the developing sleeve 8 interposed therebetween. The layer-thickness regulating blade 9 is made of a non-magnetic material such as aluminum and functions as a bristle cutting member that regulates the bristle length of magnetic brush bristles of the developer born on the developing sleeve 8. The developer which passes through a gap between the front end of the layer-thickness regulating blade 9 and the developing sleeve 8 so that the layer thickness of the developer is uniformed is sent to a developing portion facing the photoconductive drum 10. The amount of developer born on the developing sleeve 8 and conveyed to the developing portion is adjusted by adjusting the gap between the front end of the layer-thickness regulating blade 9 and the developing sleeve 8.

The developing sleeve 8 is rotated in the direction of an arrow R8, conveys the developer to the developing portion facing the photoconductive drum 10, and thus attaches the toner of the developer to the electrostatic image on the photoconductive drum 10 to reversely develop the toner image. The developer is born on the developing sleeve 8 in a magnetic brush state by the magnetic field of the magnet roller 16, magnetic brushes are formed in the opposite portion to the photoconductive drum 10, the bristle tips of the magnetic brushes are rubbed on the photoconductive drum 10.

A power source 17 applies a vibration voltage in which an alternating-current voltage is superimposed on a negative direct-current voltage to the developing sleeve 8 and transfers only the toner from the magnetic brushes of the developer to the electrostatic image of the photoconductive drum 10. A development efficiency (that is, an attachment ratio of the toner to the electrostatic image) is improved by superimposing the alternating-current voltage, compared to a case in which the alternating-current voltage is not superimposed.

<Two-component Developer> The toner is made of a material in which a binder resin such as a styrene-based resin or a polyester resin, a coloring agent such as carbon black, a colorant, or a pigment, a mold release agent such as wax, and a charged control agent are appropriately used. The toner is manufactured by a conventional technology such as a grinding method or a polymerization method.

The toner has a negative charge property in which a friction charging amount is in the range of $-1\times10^{-2}$ C/kg to $-5.0\times10^{-2}$ C/kg. The friction charging amount of the toner may be adjusted depending on a kind of a binder resin or the like to be used or may be adjusted by addition of an external additive. The friction charging amount of the toner is measured by air-sucking the toner from the developer at the amount of developer of about 0.5 g to 1.5 g using a general blow-off method and measuring the amount of charge caused in a measurement container.

Even when the friction charging amount of toner is less than $-1\times10^{-2}$ C/kg or greater than $-5.0\times10^{-2}$ C/kg, the development efficiency is lowered. When the friction charging amount of the toner is greater than $-5.0\times10^{-2}$ C/kg, the amount of counter charge generated in the carriers is increased and a void image is generated due to attachment of the carriers, and thus the quality of an output image may deteriorate.

The carrier is manufactured by a conventional technology, and a manufacturing method is not particularly limited. A resin carrier in which carbon black is dispersed in a resin can be used to disperse a magnetite as a magnetic material in a resin and to causes the carrier to be conductive and adjust resistance. A magnetite carrier in which a magnetite simple surface such as ferrite is subjected to an oxidation-reduction process to adjust the resistance may be used, or a resin coated carrier in which the surface of magnetite simple particles such as ferrite is subjected to resin coating to adjust the resistance may be used.

The carrier has magnetization of $3.0\times10^4$ A/m to $2.0\times10^5$ A/m in a magnetic field of 0.1 tesla. The volume resistivity of the carrier is adjusted to be in the range of $10^7$ Ωcm to $10^{14}$ Ωcm in consideration of leakage or a development property.

When the amount of magnetization of the carrier is less than $3.0\times10^4$ A/m, attachment to the developing sleeve 8 by the magnet roller 16 is difficult, and thus the development efficiency tends to deteriorate. When the amount of magnetization of the carrier is greater than $2.0\times10^5$ A/m, the toner image may be disturbed due to the pressure of the magnetic brushes, and thus the quality of an image may deteriorate in some cases.

The magnetization of the carrier is measured using an oscillation magnetic field type magnetic property automatic recording apparatus BHV-30 made by Riken Denshi Co., Ltd. and the strength of magnetization in an external magnetic field of 0.1 T is calculated. A measurement sample is produced by packing carriers in a cylindrical plastic container so as to be sufficiently dense, a magnetization moment of the measurement sample is measured, and the strength ($Am^2/kg$) of the magnetization is calculated by measuring an actual weight when the measurement sample is input.

Next, an absolute specific gravity of the carrier particles is calculated using Dry Automatic Density Type Accupix 1330 (made by Shimadzu Corporation), and the strength (A/m) per unit volume is calculated by multiplying the absolute specific gravity to the previously calculated strength ($Am^2/kg$) of the magnetization.

<Control of Toner Supply> In the developing device 1, as illustrated in FIG. 2, the toner is transferred from the developing sleeve 8 to the photoconductive drum 10 with the development of a toner image. Therefore, when an image is formed, the toner density of the developer circulated inside the developing container 2 may be lowered, and thus the density of the image or the reproducibility of the mixed colors may deteriorate. To supplement the toner of each color which insufficient in the developing container 2, a developer supply device 20 supplies only the insufficient amount of toner of each color from a toner hopper 31 to the upstream side of the agitating screw 6 of the agitating chamber 4.

An inductance sensor 14 that measures a toner density is disposed in the developing container 2. A controller 51 obtains the toner density of the developer in the developing container 2 based on the output of the inductance sensor 14 and calculates a toner supply amount necessary to restore the toner density to 8%. The controller 51 rotates a supply screw 32 of the developer supply device 20 only by a rotation angle corresponding to the calculated toner supply amount and supplies the toner to the developing container 2.

When the toner density of the developer conveyed inside the developing container 2 varies, the magnetic permeability of the developer varies. Therefore, the toner density of the developer can be detected by the inductance sensor 14 that measures magnetic permeability. As the amount of magnetic substance included in the developer in a region detected by the inductance sensor 14 increases, the output of the inductance sensor 14 increases. Therefore, the output of the inductance sensor 14 is proportional to a carrier density (a weight ratio of the carriers occupying the developer in a unit weight) of the developer. Thus, a detection output (Vsig) of a magnetic sensor conflicts with the toner density of the developer in a region detected by the inductance sensor 14.

When the toner density increases, the volume ratio of the toner (non-magnetic substance) occupying the developer in a unit volume merely increases, the volume ratio of the carriers (magnetic substance) decrease, and the magnetic permeability of the developer decreases. Therefore, the detection output (Vsig) of the magnetic sensor decreases. Conversely, when the toner density decreases, the volume ratio of the carrier (magnetic substance) occupying the developer in the unit volume merely increases and the magnetic permeability of the developer increases. Therefore, the detection output (Vsig) of the magnetic sensor increases. Thus, the toner density of the non-magnetic substance can be measured using the inductance sensor 14 that measure the magnetic permeability of the magnetic substance.

The detection output (Vsig) of the inductance sensor 14 is compared to an initial reference signal (Vref) recorded in advance in a non-volatile memory element (not illustrated), and thus the toner supply amount is determined based on the calculation result of a difference (Vsig−Vref) between the detection output and the initial reference signal. The toner supply amount is determined as a toner supply time of the toner supply screw of the developer supply device 20. Since the initial reference signal (Vref) is an output value corresponding to an initial state of the developer inside the developing container 2, that is, the toner density of the initial developer, the toner supply amount is determined such that the detection output (Vsig) approaches the initial reference signal (Vref).

Here, the toner density of the initial developer is 8% and the initial reference signal (Vref) of the inductance sensor 14 is adjusted such that the output becomes 2.5 V when the toner density is 8%. When Vsig−Vref>0, the toner density of the developer is lower than a target toner density. Therefore, a necessary toner supply amount is determined according to the difference. On the other hand, when Vsig−Vref≤0, the toner density is higher than the target toner density. Therefore, the toner supply is stopped to lower the toner density according to toner consumption of an image forming operation.

As illustrated in FIG. 3, the inductance sensor 14 which is an example of a magnetic detection element generates an output according to the magnetic density of the developer conveyed along the circulation path. The inductance sensor 14 is disposed in the agitating chamber 4 close to a position at which the developer is pushed upward to be sent to and received from the developing chamber 3. The controller 51 which is an example of a controller sets the toner supply amount based on the output of the inductance sensor 14 and controls the developer supply device 20 which is an example of a supplying unit.

In the developing device 1, the developer which has a low toner density and is born in the developing sleeve 8 and used for the developing is not returned to the developing chamber 3 and is all collected in the agitating chamber 4. The agitating screw 6 mixes the developer conveyed from the developing chamber 3 through the opening 12, the developer born in the developing sleeve 8 and used for the developing, and the supplied toner in the agitating chamber 4. The agitating screw 6 mixes the supplied toner with the collected developer having a low toner density, restores the toner density to 8%, uniforms the toner density of the conveyed developer, and sends the developer to the developing chamber 3.

Thus, only the developer to which the toner is supplied and sufficiently agitated is present from the upstream side to the downstream side of the developing chamber 3, and thus the toner density of the developer conveyed in the developing chamber 3 and born in the developing sleeve 8 is maintained uniformly to be 8%. Accordingly, the developer having the normally uniform toner density is supplied to the developing sleeve 8, and thus a uniform image can be obtained without an image density difference or a color difference in the direction of the developing sleeve 8.

Other values may be used as the adjusted values of the initial toner density and the initial reference signal (Vref). Here, the supplying developer having 100% toner and no carrier is supplied. However, carriers may be supplied together and a surplus developer may be configured to be overflowed.

Here, the supply amount of the developer is directly determined based on the toner density detected by the inductance sensor 14. However, the amount of each color toner used to form each sheet of image may be calculated based on image data, the used amount of toner may be corrected according to the toner density detected by the inductance sensor 14, and the supply amount may be determined.

<Change in Output of Magnetic Detection Element> Since a vertical agitating type developing device has a developer circulation path different from that of a horizontal agitating type developing device, the vertical agitating type developing device has problems unique to the vertical agitating type developing device.

As illustrated in FIG. 3, the developing device 1 circulates the developer against the force of gravity. Therefore, a surface level T' of the developer inside the developing container 2 is inclined. When the surface level of the developer is in a stable state at a normal image forming time, the surface level T' of the developer is formed in the developing chamber 3 and the agitating chamber 4. When the developer is conveyed to the downstream side of the agitating chamber 4 by the agitating screw 6 and the opening 11 is filled sufficiently with the developer, the developer can be pushed to the developing chamber 3, and thus the developer is conveyed to the downstream side by the developing screw 5. Therefore, the surface level T' of the developer becomes higher near the opening 11.

As illustrated in FIG. 4, the developer is not preferably agitated at a time other than the image forming time in terms of deterioration in the developer. Therefore, the developing device 1 is driven only at the time of the image forming time. When the developing device 1 is stopped and the developer is not conveyed by the developing screw 5 and the agitating screw 6, the developer disperses along the developing chamber 3 and the agitating chamber 4 and the surface level T" of the developer is thus formed. Since the developer pushed upward in the developing chamber 3 by the agitating screw 6 falls toward the agitating chamber 4 and the flap-up of the developer is simultaneously stopped by the developing screw 5 and the agitating screw 6, the surface level T" of the developer is overall lowered.

As illustrated in FIG. 3, the inductance sensor 14 is disposed on the side of the agitating chamber 4 close to a position immediately below the opening 11 in order to stably detect the toner density of the developer. When the inductance sensor 14 using a change in the magnetic permeability of the developer is used as a density detection unit that detects the toner density of the developer, the inductance sensor 14 is preferably disposed on the side of the agitating chamber 4 of the opening 11. Here, the developer conveyed and stopped at the end of the downstream side of the lower agitating chamber 4 by the agitating screw 6 can be pushed from the lower side to the upward side with the rise of the pressure of the developer, and thus the developer is sent to and received from the upper developing chamber 3 by causing the developer to overflow from the opening 11. The inductance sensor 14 detects the carrier density. Therefore, when a gap of the carrier increases, an appearance toner density calculated based on the output of the inductance sensor 14 may increase in spite of the fact that the actual toner density does not vary. For this reason, the inductance sensor 14 is disposed on the side of the agitating chamber 4 at the position which is located immediately below the opening 11 and at which the carrier density associated with the rotation of the agitating screw 6 is small due to the highest pressure of the developer in the developing container 2. In addition, since the agitating chamber 4 immediately below the opening 11 is normally filled with the developer in both the stop state in FIG. 4 and the normal state in FIG. 3, the developer is normally present even in the change in the amount of developer.

In the developing device 1, an image is formed while maintaining the state of the surface level T' of the developer in FIG. 3, after the developing device 1 stopped in the state of the surface level T" of the developer in FIG. 4 is activated and then an image starts to be formed at the time of the state of the surface level T' of the developer in FIG. 3. Further, in a course from the stop of the developing device 1 in the state of the surface level T" of the developer in FIG. 4 to the normal circulation of the developer in the state of the surface level T' of the developer in FIG. 3, the pressure of the developer detected by the inductance sensor 14 increases, and thus the carrier density of the developer considerably varies. Since the portion below the opening 11 is necessarily filled with the developer to form the surface level T' of the developer in FIG. 3 from the surface level T" of the developer in FIG. 4, the density of the developer near the inductance sensor 14 considerably varies in the course from the surface level T" of the developer to the surface level T' of the developer.

When only a small number of sheets such as one sheet or two sheets is printed, an image forming process may end in some cases before the normal circulation of the developer in the state of the surface level T' of the developer in FIG. 3. In this case, since the density of the developer near the inductance sensor 14 considerably varies and the carrier density is not stabilized, the toner density is detected. Of course, a right toner density may not be detected. The toner supply amount determined based on the output of the inductance sensor 14 may be inaccurate.

In order to resolve this problem, it can be considered that the detection timing of the toner density by the inductance sensor 14 is delayed until stabilization of the surface level of the developer inside the developing container 2, and the toner density is detected by the inductance sensor 14 after the stabilization of the surface level of the developer. However, since it takes some time to stabilize the surface level of the developer in the developing device 1, the developer has to be unnecessarily agitated until the stabilization of the surface level of the developer, and thus the deterioration in the developer may be accelerated. Further, when only a small number of sheets such as one sheet or two sheets is printed, the toner may not be supplied due to the elapse of the detection timing of the toner density by the inductance sensor 14.

Accordingly, in embodiments to be described below, an accurate toner supply amount is calculated by correcting the appearance toner density based on the output of the inductance sensor 14 and preventing the toner density from being erroneously detected even when only a small number of sheets such as one sheet or two sheets is printed.

First Embodiment

Figure 5:
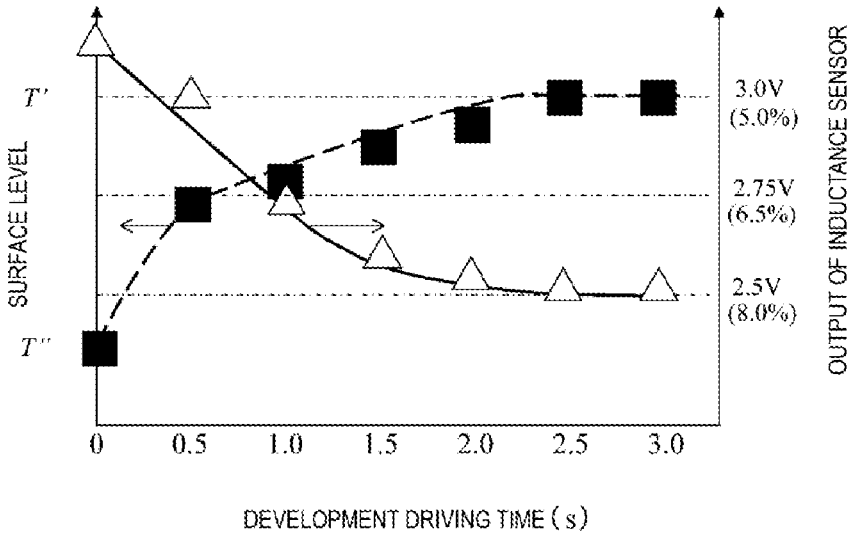
FIG. 5 is a diagram illustrating a change in the output of an inductance sensor after the developing device is activated.
Figure 6:
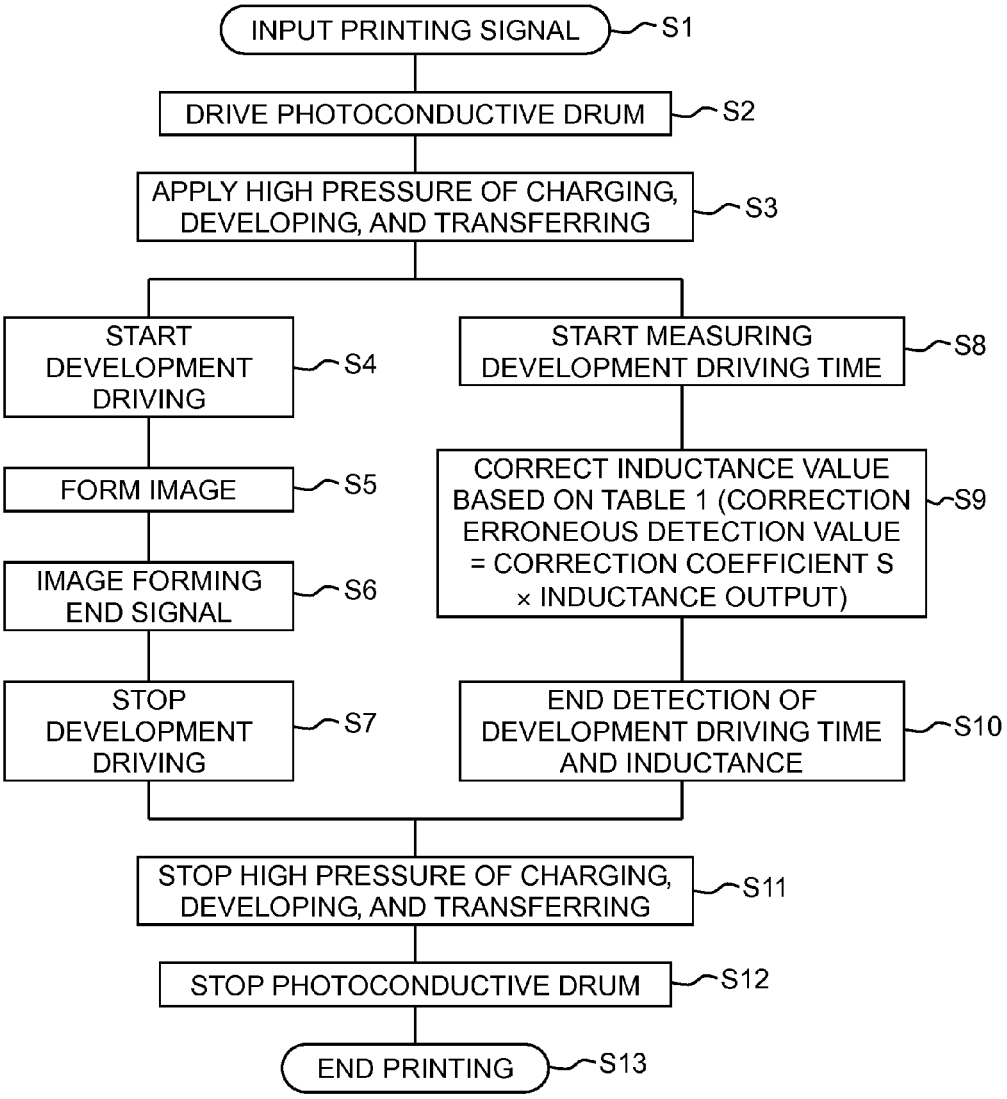
FIG. 6 is a flowchart illustrating image formation control according to a first embodiment.

FIG. 5 is a diagram illustrating a change in the output of the inductance sensor after the developing device is activated. FIG. 6 is a flowchart illustrating image formation control according to a first embodiment.

As illustrated in FIG. 5, the output of the inductance sensor 14 indicated by Δ is lowered, as the agitating screw 6 of the developing device 1 starts to be driven and the surface level T" of the developer of the developing chamber 3 indicated by ■ and located immediately above the inductance sensor 14 is raised toward the surface level T' of the developer. This is because the appearance density of the developer is lowered in a course in which the developer stopped and entering an aggregation state is agitated and the particles are moved and friction-charged one another, and thus the number of carriers present in the detection region of the inductance sensor 14 decreases (the intervals of the particles expand).

When the development driving time exceeds 2.5 sec and the surface level of the developer is stabilized, the appearance density of the developer also converges into a constant value and the output of the inductance sensor 14 is stabilized.

However, in a case in which the conveyance speed of the recording material conveying belt 24 is 350 mm/sec and an image is formed by transporting an A4 sheet horizontally, an actual image forming time is merely 0.6 sec per sheet due to the fact that the width of the A4 sheet is 210 mm, although margins are included. Even when the number of rotations of the developing sleeve 8 is considered to be stable, a total of time of 1.0 sec after the activation of the developing device 1 suffices.

When the developing device 1 is activated and then three or more sheets do not pass by transporting an A4 sheet horizontally, the development driving time is not equal to or greater than 2.5 sec and the surface level of the developer is not stabilized. Therefore, when the image forming process is performed to form images less than three sheets by transporting the A4 sheet horizontally, the output of the inductance sensor 14 is not stabilized. At this time, the inductance sensor 14 erroneously detects a toner density which is lower than the actual toner density. Therefore, when the developer supply device 20 is controlled simply based on the output of the inductance sensor 14, a surplus toner may be supplied to the developing device 1.

Accordingly, in the first embodiment, the surplus toner is configured not to be supplied to the developing device 1 by correcting the toner density based on the output of the inductance sensor 14 to be lowered than that after 2.5 seconds until 2.5 seconds from the activation of the developing device 1 with reference to Table 1.

TABLE 1

| DEVELOPMENT DRIVING TIME (sec) | 0.5 | 1.0 | 1.5 | 2.0 | 2.5 OR MORE |
|---|---|---|---|---|---|
| CORRECTION COEFFICIENT | 0.83 | 0.91 | 0.96 | 0.98 | 1.0 |

Table 1 illustrates calculation results of correction coefficients of the output of the inductance sensor 14 at predetermined times of 0 to 2.5 seconds from the activation of the developing device 1 from a relation between the development driving time illustrated in FIG. 5 and the output of the inductance sensor. The correction coefficients are numerical values of 2.5 V after 2.5 seconds, when the outputs of the inductance sensor 14 at the predetermined times of 0 seconds to 2.5 seconds are integrated in the developer with the toner density of 8%. The correction coefficients in Table 1 are constant irrespective of a period from end of the previous image forming process to start of the subsequent image forming process.

In the first embodiment, the controller 51 which is an example of a first detection unit detects information (a time or the number of formed images) regarding an elapsed time after the developer starts to be conveyed by the developing screw 5 and the agitating screw 6 according to an image formation start signal. The controller 51 sets the toner supply amount to be smaller for the same output of the inductance sensor 14 when the elapsed time is less than a predetermined time until the stabilization of the surface level of the developer based on the detection information regarding the elapsed time than when the elapsed time is equal to or greater than the predetermined time. The controller 51 reduces a ratio at which the toner supply amount is set to be small for the same output of the inductance sensor 14, as the elapsed time approaches the predetermined time until the surface level of the developer is stabilized based on the detection information regarding the elapsed time.

As illustrated in FIG. 6, when a printing signal is input to the image forming apparatus 100 with reference to FIGS. 1 and 2 (S1), the controller 51 drives the photoconductive drum 10 and the recording material conveying belt 24 (S2).

The controller 51 applies each high pressure of charging, developing, and transferring (S3) and drives the developing device 1 (S4).

The controller 51 starts driving the developing screw 5, the agitating screw 6, and the developing sleeve 8 inside the developing container 2 and simultaneously starts measuring the development driving time (S8).

The controller 51 performs an image creating operation such as exposure (S5) and detecting of the toner density by the inductance sensor 14 (S9) in parallel.

The controller 51 calculates the toner supply amount by acquiring the output of the inductance sensor 14 every 0.5 sec after the driving start of the developing device 1 (S9). At this time, the output of the inductance sensor 14 is corrected and calculated based on Table 1 (S9).

For example, when the development driving time is 1.0 sec, the toner density of the developer is calculated by multiplying the output voltage of the inductance sensor 14 by the correction coefficient of 0.91 in Table 1 and considering that the voltage is output from the inductance sensor 14. As illustrated in FIG. 5, the toner density can be determined to be same as 8% after 2.5 seconds by considering that 2.5 V obtained by multiplying the output value of 2.75 V at the time of 1.0 second by 0.91 is output from the inductance sensor 14. Thus, 6.5% corresponding to the output voltage of 2.75 V at that time from the inductance sensor 14 is not erroneously determined to be the current toner density.

Thereafter, when the controller 51 receives an image formation ending signal (S6), the controller 51 stops the development driving (S7) and simultaneously ends the measurement of the development driving time and the detection of the output of the inductance sensor 14 (S10).

The controller 51 stops each high pressure output of the charging, the developing, and the transferring (S11), stops the photoconductive drum 10 and the recording material conveying belt 24 (S12), and then ends the printing operation (S13).

Advantages of First Embodiment

It is confirmed whether the toner is normally supplied from the developer supply device 20 by repeating the image forming process of printing one sheet of an entire-surface image with the maximum density on a plain paper of the A4 size from the stop state of the image forming apparatus 100 and stopping the image forming apparatus 100. A change in the actual toner density is compared between the first embodiment in which the toner supply amount is corrected with the elapse of a time after the activation of the developing device by extracting a small amount of developer from the developing device 1 and measuring the actual toner density repeatedly a predetermined number of times and a comparative example in which no correction is performed.

TABLE 2

| NUMBER OF PERFORMANCES | 0 TIMES | TEN TIMES | TWENTY TIMES | THIRTY TIMES | FORTY TIMES |
|---|---|---|---|---|---|
| TONER DENSITY TRANSITION IN COMPARATIVE EXAMPLE IN WHICH NO CORRECTION IS | 8% | 8.5% | 9.3% | 9.9% | 10.2% |

TABLE 2-continued

| NUMBER OF PERFORMANCES | 0 TIMES | TEN TIMES | TWENTY TIMES | THIRTY TIMES | FORTY TIMES |
|---|---|---|---|---|---|
| PERFORMED TONER DENSITY TRANSITION IN FIRST EMBODIMENT | 8% | 8.3% | 7.8% | 7.9% | 8.2% |

As illustrated in Table 2, the toner supply amount is appropriately set in every image forming process by the control of the first embodiment. Therefore, the toner density of the developer remains to be about 8% which is almost the same as the initial value, even when the image forming process is repeated.

However, in the comparative example in which the toner supply amount is not corrected, the actual toner density gradually increases as the number of times the image forming process is performed is repeated. As described above, the toner density of 8% is erroneously detected by 1.5% with 6.5%, when one sheet of image is formed. Therefore, since the surplus toner is supplied, the actual toner density will increase up to 9.5% theoretically. However, the actual toner density increases up to 10.2% at the end of forty times with reference to Table 2. This is because the fluidity of the developer deteriorates due to the increase in the toner density and it takes a long time to stabilize the surface level of the developer from the activation of the developing device.

Thus, in the first embodiment, the erroneous detection of the toner density caused in a short-time image forming process can be prevented by providing a table for correcting a relation between the development driving time and the output of the inductance sensor in advance.

In this embodiment, the example has been described in which the detection output (Vsig) which is the output value of the inductance sensor is corrected. However, the same advantage can be obtained even when the initial reference signal (Vref) is corrected instead without correction of the detection output (Vsig).

In this embodiment, the correction of the output of the inductance sensor has been performed in each image forming process irrespective of a neglect time from the end of the previous image forming process to start of the subsequent image forming process. However, the following control may be performed in addition to this correction. That is, a neglect time from the end of the previous image forming process and the start of the subsequent image forming process may be measured, the amount of decrease in triboelectricity of the developer for the neglect time may be estimated, and the output of the inductance sensor may be corrected by adding the amount of decrease in the triboelectricity.

Second Embodiment

Figure 7:
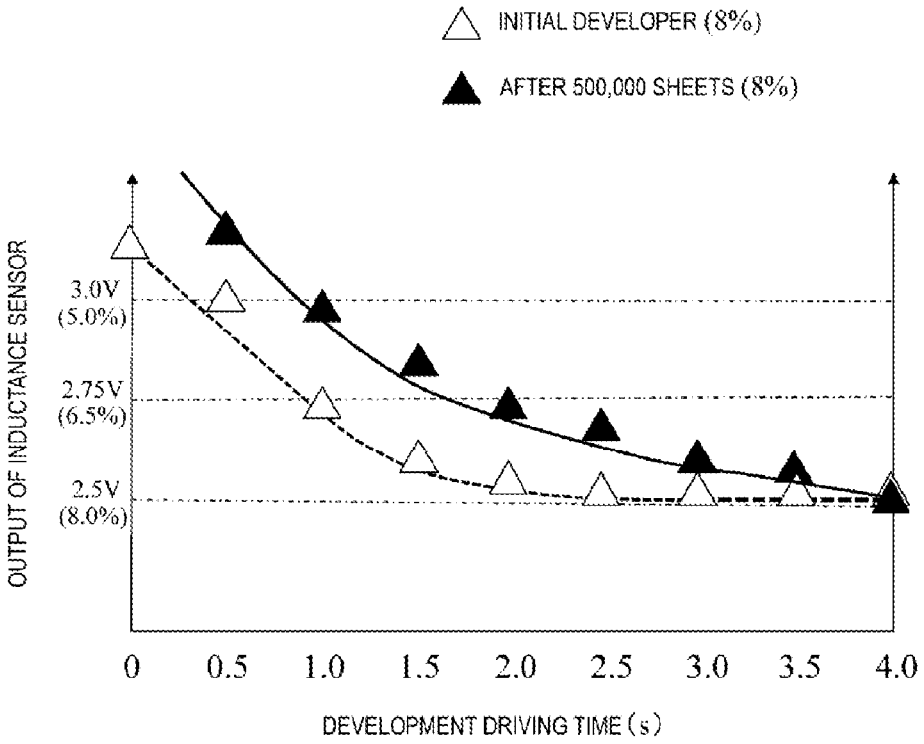
FIG. 7 is a diagram illustrating a variation in a relation between a development driving time and the output of the inductance sensor caused due to deterioration in the fluidity of the developer.
Figure 8:
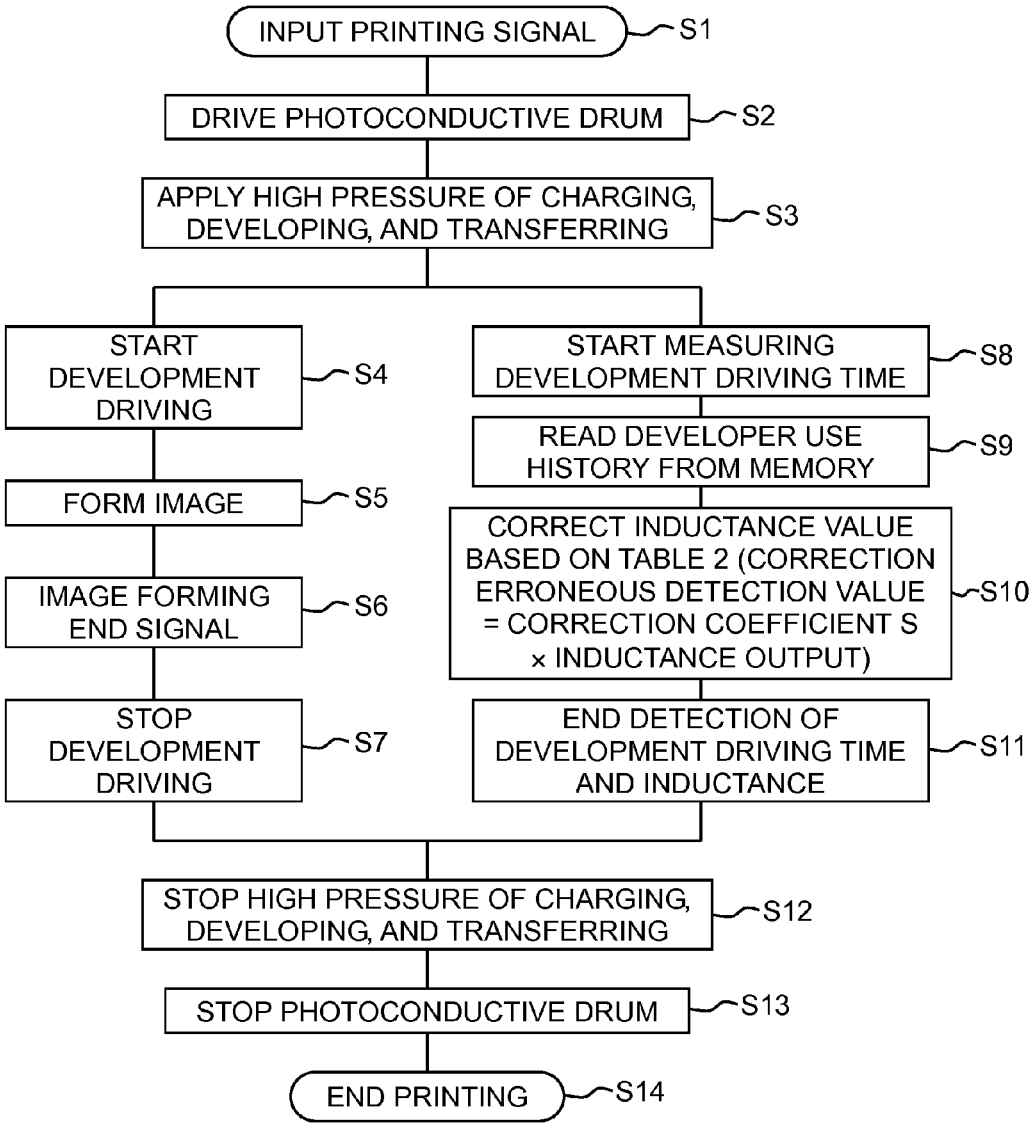
FIG. 8 is a flowchart illustrating image formation control according to a second embodiment.

FIG. 7 a diagram illustrating a variation in a relation between the development driving time and the output of the inductance sensor caused due to deterioration in the fluidity of the developer. FIG. 8 is a flowchart illustrating image formation control according to a second embodiment.

In the first embodiment, the output of the inductance sensor is corrected only according to the development driving time. Therefore, the output of the inductance sensor is likewise corrected according to the development driving time, even after the developer is continuously used for a long time. However, when the developer is continuously used for a long time and external additive particles such as a charged control agent of the surface of the toner of the developer may be isolated or a mold release agent such as wax is exposed to the surface, the fluidity of the developer deteriorates. When the fluidity of the developer deteriorates, the relation between the development driving time and the output of the inductance sensor is different from the relation before the deterioration in the fluidity of the developer. Therefore, the toner density may be erroneously detected for the developer using the same table.

As illustrated in FIG. 7, the surface level of the developer is stabilized at 2.5 seconds after the activation of the development device in the developer in the initial state in which the developer is rarely used, as described in the first embodiment, and thus the toner density is not erroneously detected. On the other hand, it takes 4.0 seconds, until the surface level of the developer deteriorating in the fluidity is stabilized by performing 500,000 sheets of images, and thus the toner density is not erroneously detected. Since it is difficult to convey the developer used for a long time and deteriorating in the fluidity in the developing container, a time is necessary until the surface level of the developer is stabilized.

Therefore, in regard to the initial developer and the developer after the formation of 500,000 images, it is necessary to correct the output of the inductance sensor according to the development driving time using different tables.

TABLE 3

| | DEVELOPMENT DRIVING TIME (sec) | | | | | | | |
|---|---|---|---|---|---|---|---|---|
| | 0.5 | 1.0 | 1.5 | 2.0 | 2.5 | 3.0 | 3.5 | 4.0 OR MORE |
| CORRECTION COEFFICIENT (INITIAL) | 0.83 | 0.91 | 0.96 | 0.98 | 1.0 | 1.0 | 1.0 | 1.0 |
| CORRECTION COEFFICIENT (INITIAL TO 500,000 SHEETS) | LINEAR INTERPOLATION BETWEEN INITIAL AND 500,000 SHEETS | | | | | | | |
| CORRECTION COEFFICIENT (500,000 SHEETS) | 0.78 | 0.83 | 0.88 | 0.91 | 0.93 | 0.96 | 0.98 | 1.0 |

In the second embodiment, as illustrated in Table 3, the toner density is prevented from being erroneously detected using different tables between the initial developer and the developer after the formation of 500,000 sheets of images. In Table 2, as described in the first embodiment, the correction coefficient of the output of the inductance sensor 14 at each time is calculated from the relation between the development driving time and the output of the inductance sensor illustrated in FIG. 7. The correction coefficient is a numerical value of 2.5 V, when the output of the inductance sensor 14 at each time of 0 seconds to 4.0 seconds is integrated in the developer with the toner density of 8%.

The table of each stage not described in Table 3 between the initial developer and the developer after the formation of 500,000 sheets of images is created by performing linear interpolation on the correction coefficients of the table of the initial developer and the correction coefficients of the table of the developer after the formation of 500,000 sheets of images.

In the second embodiment, a controller 51 which is an example of a second detection unit detects information (a time or the number of formed images) regarding a cumulative use time of the developer in the developing chamber 3 and the agitating chamber 4. Further, as the cumulative use time increases, the controller 51 increases a ratio at which the toner supply amount is set to be small with respect to the same output of the inductance sensor 14 based on the detection information regarding the cumulative use time. Furthermore, based on the detection information regarding the cumulative use time, the controller 51 estimates a predetermined time until the stabilization of the surface level of the developer, as the cumulative use time increases.

As illustrated in FIG. 8, when a printing signal is input to the image forming apparatus 100 with reference to FIGS. 1 and 2 (S1), the controller 51 drives the photoconductive drum 10 and the recording material conveying belt 24 (S2).

The controller 51 applies each high pressure of charging, developing, and transferring (S3), drives the developing device 1 (S4), and starts measuring the development driving time (S8).

The controller 51 performs an image creating operation (S5) and detecting of the toner density by the inductance sensor 14 (S9) in parallel. In the toner density detection, the toner supply amount is calculated by acquiring the output of the inductance sensor 14 at intervals of 0.5 seconds from the activation of the developing device (S9).

The controller 51 reads the current developer use history from a memory of the developing device 1 (S9) and creates a table according to the correction coefficient of the table of the initial developer in Table 3 and the use history in the table of the developer after the formation of 500,000 sheets of images. Then, the corrected toner density is obtained by multiplying the correction coefficients of the created table by the output of the inductance sensor 14 (S10).

For example, when the development driving time is 1.0 second, the output of the inductance sensor 14 is multiplied by 0.91 for the initial developer and the output of the inductance sensor 14 is multiplied by 0.83 for the developer after the formation of 500,000 sheets of images.

Thereafter, when the controller 51 receives an image formation ending signal (S6), the controller 51 stops the development driving (S7) and also ends the measurement of the toner density (S11). The controller 51 stops each high pressure output of the charging, the developing, and the transferring (S12), stops the photoconductive drum 10 and the recording material conveying belt 24 (S13), and then ends the printing operation (S14).

Advantages of Second Embodiment

As in the first embodiment, it is confirmed whether the toner is normally supplied from the developer supply device 20 by repeating the image forming process of printing one entire-surface image with the maximum density on a plain paper of the A4 size. A change in the actual toner density is compared using the developer after the formation of 500,000 sheets of images among "a comparative example in which no correction is performed," "the first embodiment in which the correction table of the initial developer is used," and "the second embodiment in which the correction table of the developer after the formation of 500,000 sheets of images is used."

TABLE 4

| NUMBER OF PERFORMANCES | 0 TIMES | TEN TIMES | TWENTY TIMES | THIRTY TIMES | FORTY TIMES |
|---|---|---|---|---|---|
| TONER DENSITY TRANSITION IN COMPARATIVE EXAMPLE IN WHICH NO CORRECTION IS PERFORMED | 8.0% | 9.0% | 9.9% | 10.9% | 12.1% |
| TONER DENSITY TRANSITION IN FIRST EMBODIMENT | 8.0% | 8.6% | 9.0% | 9.2% | 9.7% |
| TONER DENSITY TRANSITION IN SECOND EMBODIMENT | 8.0% | 8.3% | 7.9% | 7.9% | 8.1% |

As illustrated in Table 4, in the case of "the comparative example in which no correction is performed," the actual toner density gradually increases the number of performances up to 12.1% at each number of times. Since the development driving time is 1.0 second in the image forming process of printing one sheet of image, as illustrated in FIG. 7, the toner density of 8% is erroneously detected to 11.0% by 3.0% and the actual toner density will increase up to 11% theoretically. In practice, however, the toner density increases up to 12.1% when the image forming process is performed forty times. This is because the fluidity of the developer further deteriorates due to the increase in the toner density, a time increases until the stabilization of the surface level of the developer, and thus the measurement error of the toner density is expanded.

In the case of the "first embodiment" in which the correction table of the initial developer is used, the degree of erroneous detection is smaller and the toner density increases by about 1.7%, compared to the comparative example in which no correction is performed. As illustrated in FIG. 7, a deviation of about 1.5% occurs in conversion of the toner density between the initial developer and the developer after the formation of 500,000 sheets of images, when the development driving time is 1.0 second. This deviation occurs in the actual toner density, when verification is actually performed.

On the other hand, in the case of the "second embodiment" in which the correction table of the developer after the formation of 500,000 sheets of images is used, the actual toner density remains to be about 8% which is the same as the initial density, even when the number of performances is nearly forty times.

In the second embodiment, as described above, the table in which the relation between the development driving time and the output of the inductance sensor 14 is corrected to a uniform value is corrected and used according to the developer use history. Therefore, the erroneous detection of the toner density caused in a short-time image forming process can be prevented not only in the initial developer but also in the developer considerably deteriorating in the fluidity since the developer is used for a long time.

Third Embodiment

In the second embodiment, the correction coefficient of the output of the inductance sensor 14 has been changed in consideration of the deterioration in the fluidity of the developer caused with an increase in the cumulative use time of the developer. However, even when the fluidity of the developer also deteriorates due to an increase in temperature or an increase in humidity. Further, even when the actual density of the developer increases, the fluidity of the developer deteriorates.

Accordingly, in a third embodiment, a fluidity parameter other than the cumulative use time of the developer is considered. The toner density is corrected by providing "a table used to correct the output of the inductance sensor 14 according to the development driving time" in each temperature and humidity inside the developing device and each toner density of the developer. Further, the toner density may be corrected using the same table by a fluidity parameter other than the cumulative use time of the developer, the temperature, the humidity, and the toner density.

That is, a temperature and humidity sensor or a toner density sensor (not illustrated) which is an example of a third detection unit detects information regarding the fluidity of the developer. Based on the detection information of the temperature and humidity sensor or the toner density sensor, the controller 51 sets a ratio, in which the toner supply amount is set to be smaller with respect to the same output of the inductance sensor 14, to increase, as the fluidity of the developer deteriorates.

Fourth Embodiment

Figure 9:
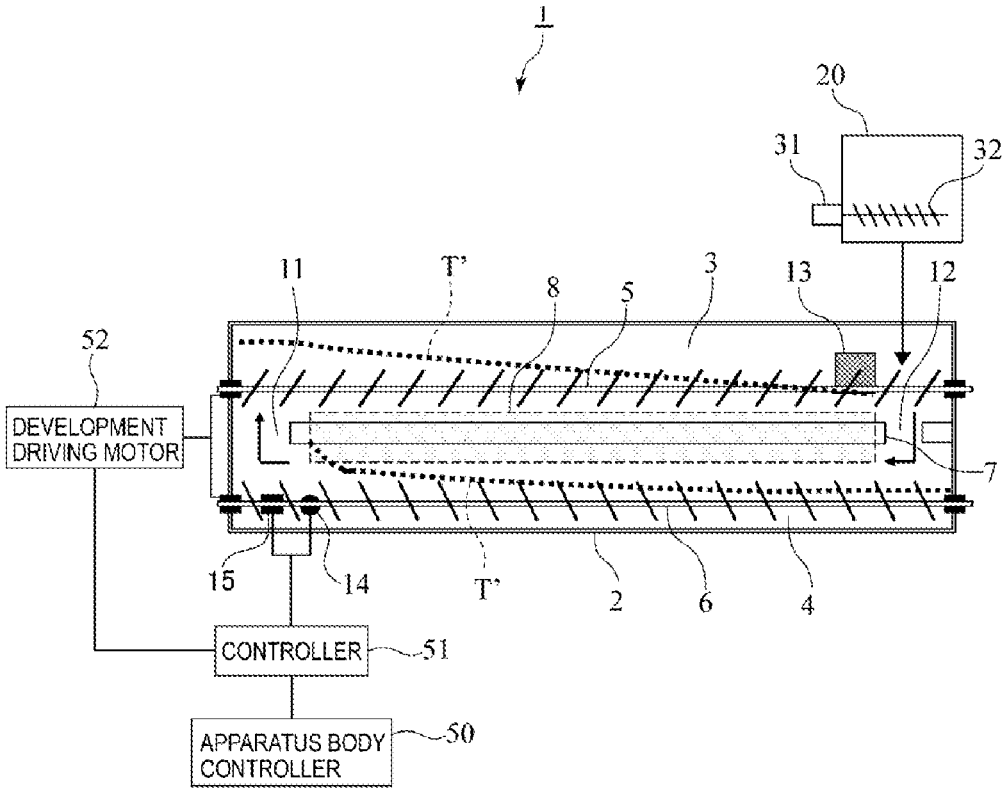
FIG. 9 is a diagram illustrating arrangement of a pressure sensor according to a fourth embodiment.
Figure 10:
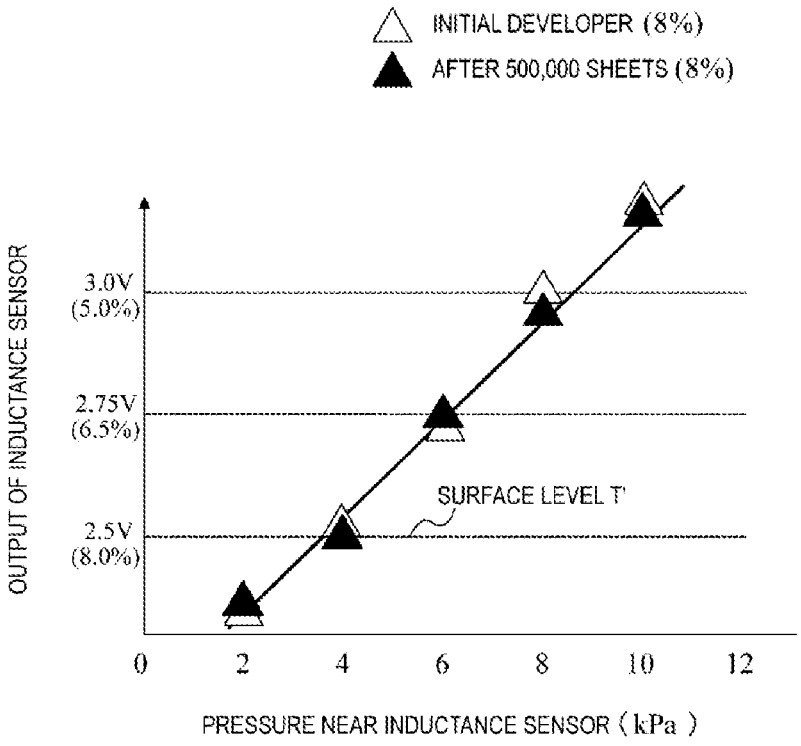
FIG. 10 is a diagram illustrating a relation between the pressure of a developer near the inductance sensor and the output of an inductance sensor.
Figure 11:
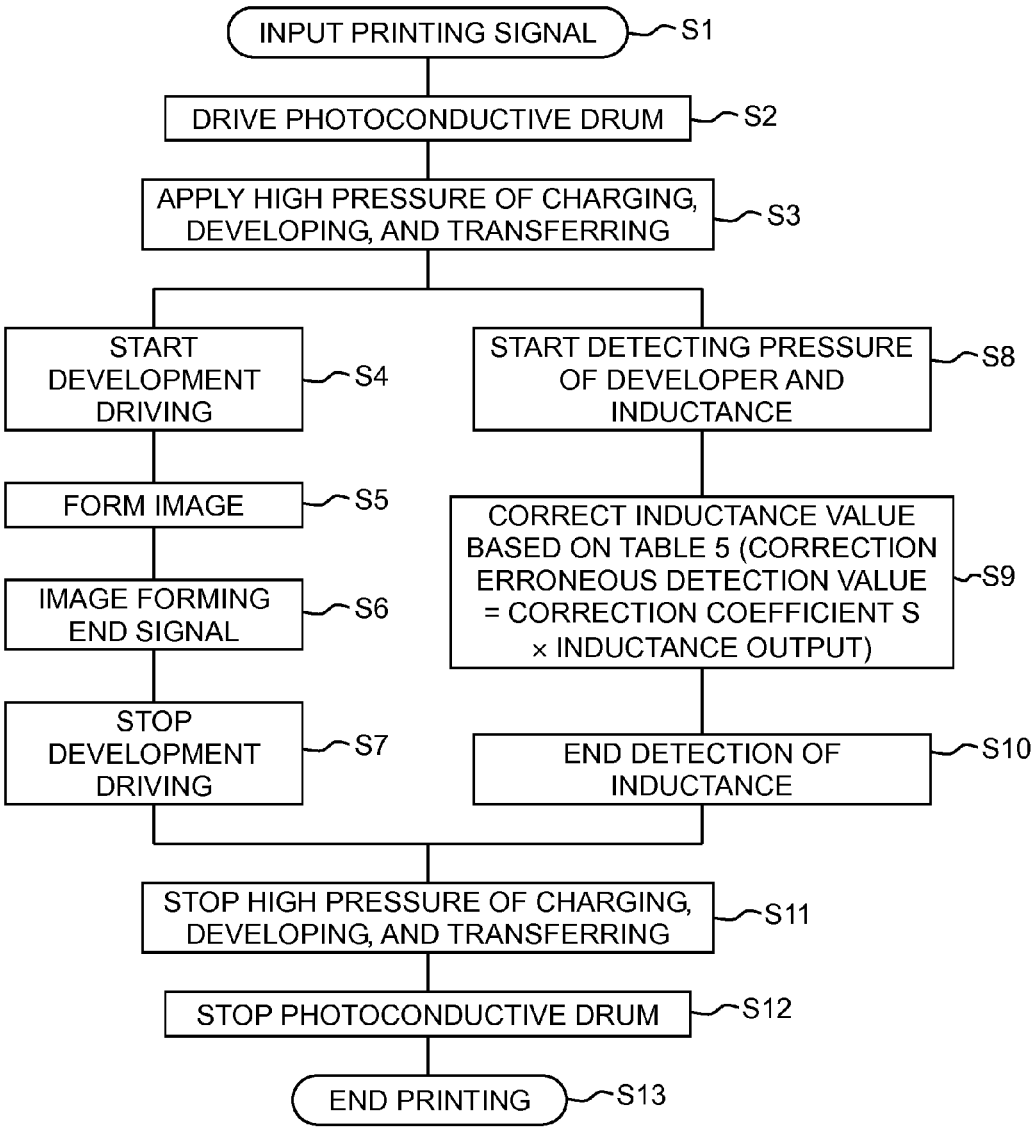
FIG. 11 is a flowchart illustrating image formation control according to the fourth embodiment.

FIG. 9 is a diagram illustrating disposition of a pressure sensor according to a fourth embodiment. FIG. 10 is a diagram illustrating a relation between the pressure of a developer near the inductance sensor and the output of an inductance sensor. FIG. 11 is a flowchart illustrating image formation control according to the fourth embodiment.

In the second embodiment, the output of the inductance sensor 14 has been corrected using the table in which the correction coefficients are calculated by estimating the change in the output of the inductance sensor 14 in advance according to the change in the fluidity of the developer. In the fourth embodiment, the pressure of the developer detected by the inductance sensor 14 is measured and the output of the inductance sensor 14 is corrected according to the pressure.

As described in the third embodiment, the fluidity of the developer is changed due to various factors such as a temperature, a humidity, a toner density, the use state of the developing device, and a cumulative operation time. Therefore, when a table is created by considering all of the fluidity parameters, a time is considerably necessary in design. Further, when a situation in which a fluidity parameter is not slightly assumed occurs, there is a probability that the toner density may not be accurately corrected.

The inductance sensor 14 does not respond to a non-magnetic toner included in the developer and responds to a magnetic carrier included in the developer. The inductance sensor 14 generates an output according to the carrier density occupying the developer of the unit volume coming into contact with the inductance sensor 14. Therefore, when the fluidity of the developer deteriorates and the developer tends to stay near the opening 11 and the gap of the carriers is reduced, the toner is also reduced, and thus the toner density deteriorates and erroneous detection occurs.

As illustrated in FIG. 9, a pressure sensor 15 is provided near the inductance sensor 14 and actually measures the developer pressure of the developer detected by the inductance sensor 14. The pressure sensor FOP-M made by FISO Technologies Inc. is used as the pressure sensor 15. A relation between the pressure near the inductance sensor 14 and the output of the inductance sensor 14 is examined for "the initial developer with the toner density of 8%" in which the fluidity does not deteriorate and "the developer with the toner density of 8% after the formation of 500,000 sheets of images" in which the fluidity deteriorates.

As a result, as illustrated in FIG. 10, it is proved that the output of the inductance sensor 14 measured at the same developer pressure is the same between the initial developer and the developer after the formation of 500,000 sheets of images. When the developer is stabilized with the surface level T', it is proved that the developer pressures of the initial developer and the developer after the formation of 500,000 sheets of images are 4 kPa and the toner density based on the output of the inductance sensor 14 is 8% which is the same as the actual toner density. Since the fact that the developer pressure increases over 4 kPa is identical with the fact that the developer density increases, the output of the inductance sensor 14 increases, and thus the toner density is erroneously detected when the toner density is consequently low. At this time, the toner density is erroneously detected likewise at the same developer pressure for the initial developer and the developer after the formation of 500,000 sheets of images.

This result indicates that the inductance sensor 14 erroneously detects the toner density likewise irrespective of the fluidity of the developer when the developer pressures near the inductance sensor 14 are identical. The cause for the inductance sensor 14 to erroneously detect the toner density is that the developer density near the inductance sensor 14 varies, and the developer density near the inductance sensor 14 is proportional to the developer pressure near the inductance sensor 14. Therefore, when the developer pressure near the inductance sensor 14 is actually measured, the developer density can directly be comprehended and the toner density can be corrected without consideration of the above-described fluidity parameters.

In the fourth embodiment, the controller 51 detects the developer density of the developer of which the toner density is detected by the inductance sensor 14 in real time based on the output of the pressure sensor 15. The controller 51 corrects the output of the inductance sensor 14, while the pressure sensor 15 monitors the developer pressure near the inductance sensor 14. Therefore, even when the fluidity of the developer varies due to an unexpected cause, the toner density of the developer can normally be detected with accuracy.

In Table 5, the correction coefficient of the output of the inductance sensor is calculated at each stage of the developer pressure from the relation between the developer pressure and the output of the inductance sensor in FIG. 10.

TABLE 5

| PRESSURE (kPa) | 2 | 4 | 6 | 8 | 10 |
|---|---|---|---|---|---|
| CORRECTION COEFFICIENT | 1.09 | 1.0 | 0.91 | 0.83 | 0.78 |

In Table 5, each value of the correction coefficient is set to be 2.5 V when the value is multiplied by the output of the inductance sensor 14 at a predetermined pressure.

In the fourth embodiment, the pressure sensor 15 which is an example of a fourth detection unit detects information regarding the developer pressure of a region detected by the inductance sensor 14. Based on the detection information of the pressure sensor 15, the controller 51 sets the toner supply amount to be smaller for the same output of the inductance sensor 14, as the developer pressure at the region detected by the inductance sensor 14 is higher.

As illustrated in FIG. 11, when a printing signal is input to the image forming apparatus 100 with reference to FIGS. 1 and 2 (S1), the controller 51 drives the photoconductive drum 10 and the recording material conveying belt 24 (S2).

The controller 51 applies each high pressure of charging, developing, and transferring (S3), drives the developing device 1 (S4), and starts acquiring the output of the inductance sensor 14 and the output of the pressure sensor 15 (S8).

The controller 51 performs the correction by multiplying the correction coefficient corresponding to the developer pressure near the inductance sensor 14 illustrated in Table 5 by the output of the inductance sensor 14 and calculates the toner density based on the corrected output of the inductance sensor 14 (S9). The controller 51 detects the value of the toner density by performing calculation based on Table 5 in which both the detection information of the inductance sensor 14 and the detection information of the pressure sensor 15 are stored in a memory, calculates the toner supply amount corresponding to the value of the toner density, and supplies the toner supply amount from the developer supply device 20 (S9). The detection of the value of the toner density is frequently performed in parallel to an image creating operation such as exposure (S5).

Thereafter, when the controller 51 receives an image formation ending signal (S6), the controller 51 stops the development driving (S7) and ends the measurement of the toner density (S10). The controller 51 stops each high pressure output of the charging, the developing, and the transferring (S11), stops the photoconductive drum 10 and the recording material conveying belt 24 (S12), and then ends the printing operation (S13).

Advantages of Fourth Embodiment

As in the second embodiment, it is confirmed whether the toner is normally supplied from the developer supply device 20 by repeating the image forming process of printing one sheet of an entire-surface image with the maximum density on a plain paper of the A4 size. The image forming process of printing one sheet is performed forty times using the developer after the formation of 500,000 sheets of images under the environment other than an assumption range in which the temperature is 45° C. and the humidity is 80%. During the image forming process, a change in the actual toner density is compared between the "second embodiment" in which the correction table of the developer after the formation of 500,000 sheets of images and the "fourth embodiment" in which the correction is performed based on the output of the pressure sensor 15.

TABLE 6

| NUMBER OF PERFORMANCES | 0 TIMES | TEN TIMES | TWENTY TIMES | THIRTY TIMES | FORTY TIMES |
|---|---|---|---|---|---|
| TONER DENSITY TRANSITION IN SECOND EMBODIMENT | 8% | 8.2% | 8.5% | 8.9% | 9.1% |
| TONER DENSITY TRANSITION IN FOURTH EMBODIMENT | 8% | 8.1% | 8.2% | 7.8% | 7.9% |

In the control of the second embodiment, the fluidity of the developer deteriorates except for the assumption. Therefore, the correction may not be all completed in the correction table of the developer after the formation of 500,000 sheets of images, and the toner density is erroneously detected. Therefore, the actual toner density is gradually deviated from 8%.

In the control of the fourth embodiment, the toner density is corrected, while the developer pressure is monitored. Therefore, the toner density is not erroneously detected and the actual toner density is rarely deviated from 8%.

Thus, in the fourth embodiment, the change in the development density near the inductance sensor 14 caused due to the deterioration in the fluidity of the developer is normally detected and a feedback thereof is given to the correction of the output of the inductance sensor 14. Therefore, even when the fluidity of the developer is changed due to an unexpected cause in the second and third embodiments, the toner density can accurately be detected.

Furthermore, in the fourth embodiment, the developer pressure is detected. However, the change in the fluidity of the developer can be detected even by detecting the surface level of the developer and the load of the development driving.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2011-264058, filed Dec. 1, 2011, which is hereby incorporated by reference herein in its entirety.

What is claimed is:

1. A developing device in an image forming apparatus, comprising:

a developer bearing member that bears a developer including toner and a carrier;

a first chamber that contains the developer, the first chamber being disposed to face a surface of the developer bearing member and supplies the developer to the developer bearing member;

a first conveying member rotatably disposed in the first chamber so as to convey the developer in the first chamber, a second chamber that contains the developer and is divided from the first chamber to form a circulation path with the first chamber, the second chamber being disposed to face the surface of the developer bearing member at a position vertically different from a position of the first chamber and that collects the developer from the developer bearing member;

a second conveying member rotatably disposed in the second chamber so as to convey the developer in the second chamber;

a supplying unit that supplies toner to the first or second chamber;

a magnetic detection element that generates an output according to a magnetic density of the developer of the first or second chamber;

a controller that controls a supply amount supplied by the supplying unit based on the output of the magnetic detection element; and a timer that detects information of a time, wherein, based on the information detected by the timer irrespective of a length of a progress period from an end of a previous image forming process to a start of a subsequent image forming process, in a case that a driving period of time after the first conveying member and the second conveying member start driving is under a predetermined time, the controller sets the supply amount of the supplying unit according to output of the magnetic detection element to be smaller than a case that the driving period of time is over the predetermined time.

2. The developing device according to claim 1, wherein as the driving period of time approaches the predetermined time, the controller controls the supply amount of the supplying unit with respect to a same output value of the magnetic detection element such that a difference between the supply amounts when the driving period of time is less than the predetermined time and when the driving period of time is equal to or greater than the predetermined time becomes small based on information detected by a sensor.

3. The developing device according to claim 1, further comprising:

a detection unit that detects information regarding a cumulative use time of the developer in a developing device, wherein the controller lengthens the predetermined time based on the information detected by the detection unit, as the cumulative use time increases.

4. The developing device according to claim 3, further comprising:

a pressure detection unit that detects information regarding a developer pressure of a region detected by the magnetic detection element, wherein as the developer pressure of the region detected by the magnetic detection element increases, the controller controls the supply amount of the supplying unit with respect to a same output value of the magnetic detection element such that a difference between the supply amounts when the driving period of time is less than the predetermined time and when the driving period of time is equal to or greater than the predetermined time becomes small based on the information detected by the pressure detection unit.

5. The developing device according to claim 4, wherein the controller controls the supply amount supplied by the supplying unit based on the output of the magnetic detection element and a predetermined reference value and corrects a value after the output of the magnetic detection element or corrects the predetermined reference value based on the information detected by the timer.

6. The developing device according to claim 1, further comprising:

a cumulative detection unit that detects information regarding a cumulative use time of a developing device, wherein as the cumulative use time increases, the controller controls the supply amount of the supplying unit with respect to a same output value of the magnetic detection element such that a difference between the supply amounts when the driving period of time is less than the predetermined time and when the driving period of time is equal to or greater than the predetermined time becomes small.

7. The developing device according to claim 1, wherein the controller controls the supply amount of the supply unit based on a determined fluidity of the developer inside a developing device, and wherein as the fluidity of the developer deteriorates, the controller controls the supply amount of the supplying unit with respect to a same output value of the magnetic detection element such that a difference between the supply amounts when the driving period of time is less than the predetermined time and when the driving period of time is equal to or greater than the predetermined time becomes large based on the information detected by the fluidity detection unit.

8. The developing device according to claim 1, further comprising:

a pressure detection unit that detects information regarding a developer pressure of a region detected by the magnetic detection element, wherein as the developer pressure of the region detected by the magnetic detection element increases, the controller controls the supply amount of the supplying unit with respect to a same output value of the magnetic detection element such that a difference between the supply amounts when the driving period of time is less than the predetermined time and when the driving period of time is equal to or greater than the predetermined time becomes small based on the information detected by the pressure detection unit.

9. The developing device according to claim 1, wherein the controller controls the supply amount supplied by the supplying unit based on the output of the magnetic detection element and a predetermined reference value and corrects a value after the output of the magnetic detection element or corrects the predetermined reference value based on the information detected by the timer.

10. The image forming apparatus according to claim 1, wherein the second chamber is disposed below the first chamber in a vertical direction, and the magnetic detection element is disposed at downstream side of a developer conveying direction of the second chamber.

* * * * *